United States Patent [19]

Dikta

[11] 4,402,490

[45] Sep. 6, 1983

[54] MOVABLE SOUND AND DUST INSULATING WALL PORTION FOR A METALLURGICAL MILL

[75] Inventor: Gerd Dikta, Grefrath, Fed. Rep. of Germany

[73] Assignee: Mannesmann Aktiengesellschaft, Dusseldorf, Fed. Rep. of Germany

[21] Appl. No.: 361,124

[22] Filed: Mar. 23, 1982

[30] Foreign Application Priority Data

Apr. 11, 1981 [DE] Fed. Rep. of Germany ..... 3114841

[51] Int. Cl.[3] ..... C21C 5/40

[52] U.S. Cl. ..... 266/142; 266/158; 373/9

[58] Field of Search ..... 266/142, 143, 144, 165, 266/158, 159; 98/115 R; 52/457, 458; 164/256, 258; 373/8, 9; 49/74–77, 197–203

[56] References Cited

U.S. PATENT DOCUMENTS

| | | | |
|---|---|---|---|
| 162,834 | 5/1875 | Leigh | 98/115 R |
| 2,399,341 | 11/1944 | Fraser | 98/115 R |
| 3,938,788 | 2/1976 | Josten | 266/142 |

FOREIGN PATENT DOCUMENTS

| | | |
|---|---|---|
| 2405038 | 6/1975 | Fed. Rep. of Germany . |
| 2450028 | 5/1976 | Fed. Rep. of Germany . |

OTHER PUBLICATIONS

Catalog–"Deutsche Metallturen-Werke Aug. Schwarze AG.", 11/30/72.

*Primary Examiner*—L. Dewayne Rutledge
*Assistant Examiner*—Scott Kastler
*Attorney, Agent, or Firm*—Mandeville and Schweitzer

[57] ABSTRACT

A sound and dust insulating wall separates the furnace hall from the casting hall in a metallurgical mill. In order to allow the transport of an overhead crane from one hall to the other, an upper wall portion of the separating wall pivots out of the way. The wall portion comprises frame elements and a plurality of relatively thin overlapping slats. The wall portion is opened by pivoting the frame elements about a horizontally extending hinge. The slats, secured to the frame elements by hinges, also pivot, so that the slats only block the now opened crane passageway by not more than the width of one individual slat.

6 Claims, 4 Drawing Figures

MOVABLE SOUND AND DUST INSULATING WALL PORTION FOR A METALLURGICAL MILL

BACKGROUND OF THE INVENTION AND DESCRIPTION OF THE PRIOR ART

The invention relates to the structure of a metallurgical mill. More specifically, the inventive structure is intended for specific use with an electric-arc steel mill, in which the furnace hall, provided with at least one electric arc furnace is surrounded by sound dampening or sound insulating walls.

As is well known, electric arc furnaces, because they necessarily operate with attendant noise and dust are a tremendous strain on the surrounding environment. Attempts have, therefore, been made for some time to surround the electric arc furnaces with sound dampening or insulating walls and, in addition, to provide the furnace with a casing comprising an efficient dust-removal mechanism. This casing for the electric arc furnace significantly impairs, however, the accessibility of the furnace itself while it is in operation, particularly when it is desirably charged with scrap materials from above. Accessibility is impaired because the furnace casing is provided with wall elements which are difficult and time consuming to open so that the scrap charging crane can pour scrap into the furnace. It is true, however, that the electric arc furnace is normally switched off when the casing is opened so that there is little noise stress on the environment. However, the continual opening and closing of the casing wall elements is a tedious and lengthy procedure and interferes with the smooth and efficient operation of the mill. In addition, there is always the risk that the scrap carrying crane will be inadvertently driven into the not-completely-opened casing, thereby resulting in significant damage to the casing.

SUMMARY OF THE INVENTION

It is, therefore, now proposed to provide the entire furnace hall with sound dampening or sound insulating walls and to perform service on the electric arc furnace at a point outside of this sound dampened area. The furnace hall is, thereby, freed from almost all of the service personnel, with the exception of the scrap crane operator who, however, operates from within a sound-insulated and air-conditioned crane cabin.

There are, however, instances when heavy loads are required to be lifted within the furnace hall. The relatively light crane normally used for charging scrap is not capable of lifting these heavier loads. The casting ladle crane located and working in the separated casting hall is ordinarily available for such heavy load instances. As desired, the casting ladle crane can be selectively moved into the furnace hall for use therein.

In view of the fact that the furnace hall is now completely sealed off to the outside environment for sound and dust inhibiting, it is now necessary, in order to allow use of the casting ladle crane in the furnace hall, for a crane passageway into and out of the furnace hall which may be opened when the casting ladle is needed and which, however, still gives protection against sound and dust when it is closed.

For this crane passage, an opening has to be made in one wall of the furnace hall across its entire width, since the casting ladle crane track, as usually designed, extends along the width of the walls of the mill. There are, however, several alternative designs for a movable wall which are sound insulating. The present invention, however, contemplates that the upper portion of the wall surface which opens up for the passage of the casting ladle crane be capable of folding upwardly since it has been determined that the most advantageous position for the movable wall surface is directly beneath the roof of the furnace hall.

Experience has now shown that a noise dampening or insulating wall of the dimensions involved in a metallurgical mill must be of a disproportionately heavy construction if it is not to be subject to mechanical distortions in being folded upwardly while, however, not excessively sagging when in the "up" position.

The object of the present invention is the provision of a sound insulating wall of the type explained above, such that, on the one hand, the desired noise and dust protection is fully provided to the furnace hall when the wall is in the normal, folded-down position and, on the other hand, the wall is of a relatively light construction, by means of a design disclosed herein, so that it does not require special supports in view of its design and the mechanism for folding it upwardly to allow the casting ladle crane to move into the furnace hall.

The invention is further detailed in the drawings, as follows:

DETAILED DESCRIPTION OF THE DRAWINGS

Figure 1:
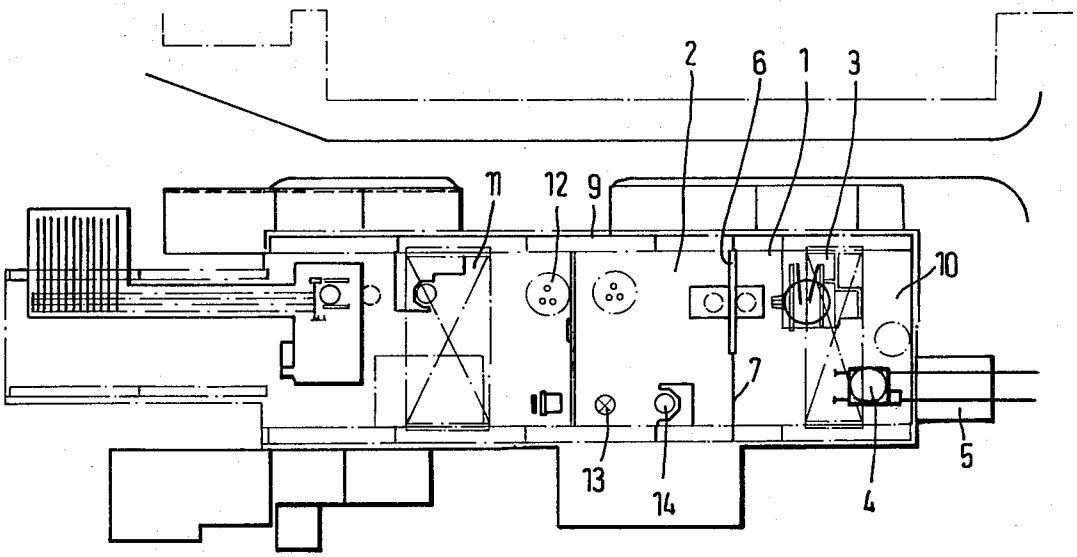
FIG. 1 is a top plan view of a metallurgical mill having a furnace hall arrangement for an electric arc furnace and a casting hall.

As best shown in FIG. 1, a schematic showing of the top plan view of the metallurgical mill arrangement, the furnace hall 1 and the liquid metal casting hall 2 are located adjacent to one another. The electric arc furnace 3 is housed in furnace hall 1. The entire furnace hall 1 is surrounded by sound insulating, i.e., sound dampening or reducing walls. Furnace hall 1 is partitioned off from the liquid metal casting hall 2 and the remaining hall portions by transverse walls, illustrated as 6 and 7. The scrap delivery vehicle 4, in the furnace hall 1, passes through a sound barrier 5 as it enters and leaves the furnace hall 1. The separating wall between the furnace hall 1 and the casting hall 2 comprises a lower stationary wall element 6 and a lower wall element 7, which is transversely displaceable. A lockable passage opening (not shown) for a casting ladle vehicle is provided in the stationary wall element 6.

The metallurgical mill arrangement is equipped with a continuous crane track 9, on which the scrap-charging crane 10 travels in the furnace hall 1, while the casting-ladle crane 11 travels on track 9 in the casting hall 2. In the casting hall 2, a cover-depository 12, a repair stand 13 and a brick-lining stand 14 can be provided.

When the casting-ladle crane 11 is desirably provided into the furnace hall 1 because, for example, a smelt must be returned from the casting hall to the electric arc furnace for reheating in the furnace hall 1, or because the furnace vessel is to be exchanged and the carrying capacity of the scrap-charging crane 10 is insufficient for that purpose, a passage opening for the bulkier and stronger casting ladle crane 11 is made in the upper portion of the separation wall consisting of the walls 6 and 7.

Figure 2:
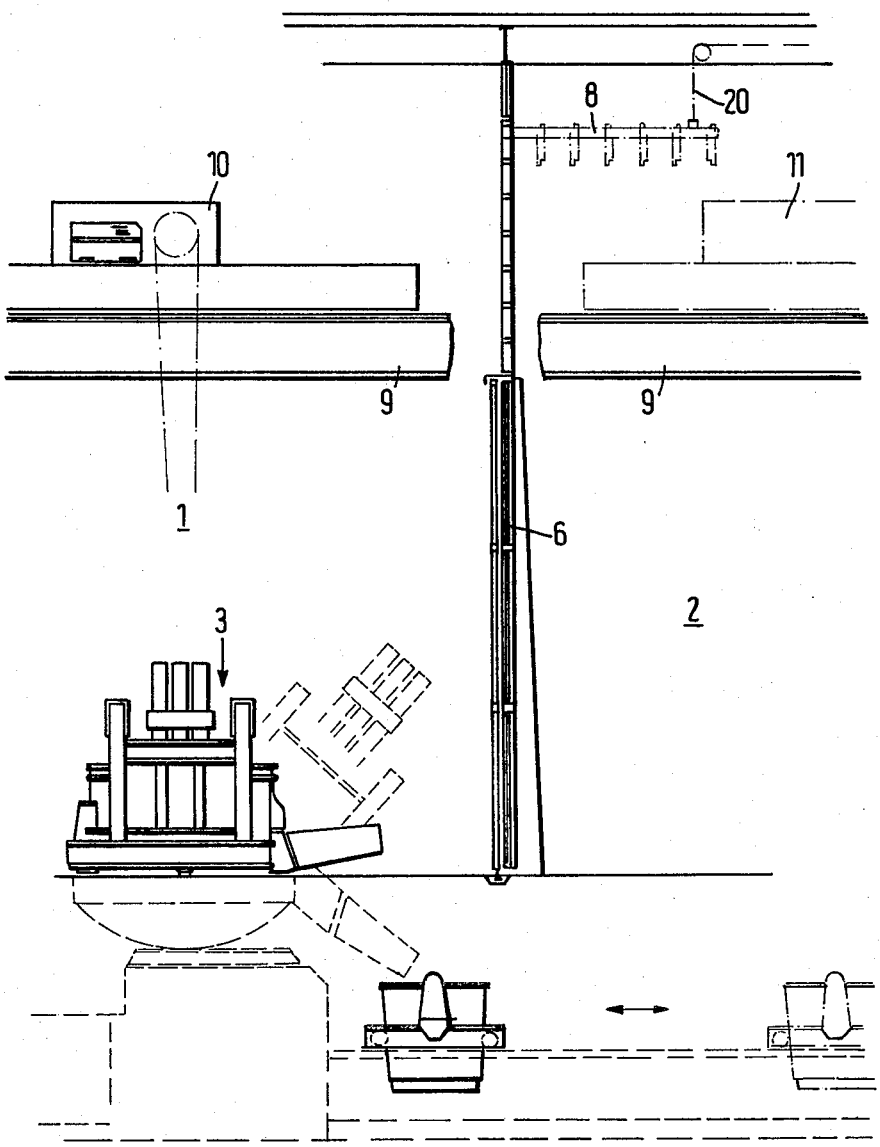
FIG. 2 is a partial cross sectional view of the metallurgical mill shown in FIG. 1, at the point of passage of the casting crane from the furnace hall to the casting hall.

FIG. 2 best illustrates the intended movement of the upper portion of walls 6 and 7. The upper area of the separating wall is designed as a wall portion or element 8, which may be pivoted upwardly around a horizontal axis, said wall element, subsequent to being pivoted upwardly, exposing a sufficient passage opening to allow the crane 11 to travel from one hall to the other hall, as desired.

Figure 3:
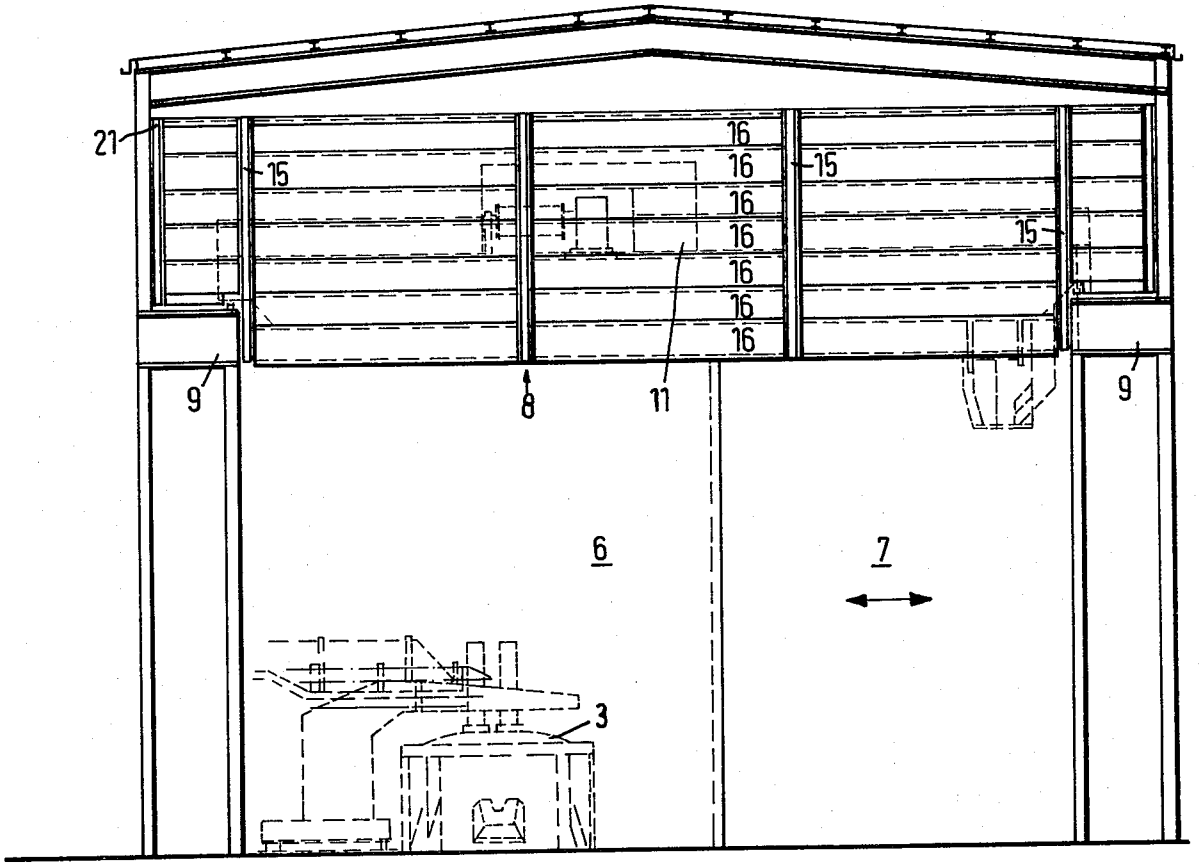
FIG. 3 is a front elevational view of the sound insulating and separating wall located between the furnace hall and the casting hall.

As is illustrated in FIG. 3, the upper wall portion or element 8 which, of course, has similar sound insulating properties as wall elements 6 and 7, is designed as a frame made of a plurality of vertical struts 15. Between the struts, which, as mentioned, extend vertically when wall element 8 is in the closed position, slats 16 are arranged, extending transversely, the slats lying adjacent to each other in the closed position of wall element 8, thereby creating a continuous sealed wall surface 8.

Figure 4:
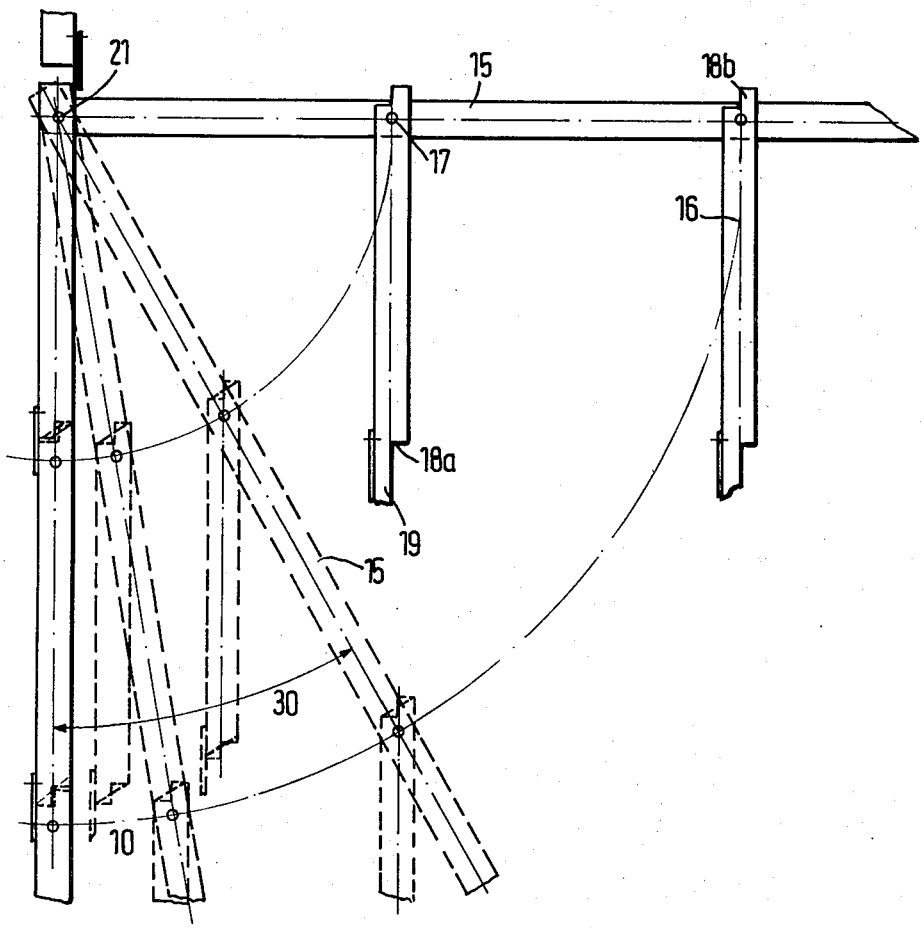
FIG. 4 is a partial cross sectional view of the upper wall portion which is selectively folded upwardly, the wall portion being shown in the figure in various positions during opening.

When wall element 8 is selectively opened, to allow for passage of the overhead casting crane 11 into and out of furnace hall 1, the wall element 8 is opened and the slats 16 pivot about hinges 17 and are suspended vertically downwardly, next to each other (see FIG. 4).

An object of the present invention is to construct a wall, which may be folded or pivoted upwardly and comprised of individual, flat elements, namely, slats which, in both the open or closed operating positions, the slats hang only in a direction parallel to their exterior flat faces. The individual slats may, therefore, be designed relatively wide and high. As the wall element 8 is folded or pivoted upwardly, the slat remain in their vertical position; they are, of course, laterally displaced. Only the width of a single slat blocks the passage of the crane 11. However, it has been determined that, compared to the advantages of the lightweight construction of the wall, this minor blocking of the wall element 8 is insignificant.

As best shown in FIG. 4, each of the slats 16 are pivotally fastened, at the vertical struts or frame elements 15, by pivot rods or hinges 17. The hinges 17 are located at the uppermost edge of the slats when the slats 16 are vertically maintained. At their ends, 18*a* and 18*b*, the slats 16 are equipped with projecting flanges and cooperating recesses which, as the wall portion or element 8 is closed (see the left portion of FIG. 4), lie closely adjacent to the projecting flanges and recesses of adjacent slats 16. Rubber strips or plates 19 serve to seal the joints formed by the overlapping recesses and flanges and, in addition, seal the slat edges. The plates 19 are arranged along the lower edges of the slats and project beyond the flanges and recesses. In the closed position, these rubber plates 19 are stationed behind the joints formed between adjacent slats, thereby not impairing the movement of the slats 16 during the opening process. The rubber plates 19 may, alternatively, be fastened at the upper edges of the respective slats and project upwardly above them. In that case, however, they must be at the leading slat sides, i.e., facing toward the fold-up direction.

The wall element or portion 8, with the slats 16, pivot during the opening and closing procedure around the horizontal axis or hinge 21. A cable of chain pull 20 (see FIG. 2) may be used for opening or closing the wall element 8. The pull 20 can be activated by a winch (not illustrated). The wall element 8, which may be folded upwardly, can, of course, be equipped with a counterweight to insure the wall element 8 stays in a substantially opened position, as desired.

The attached copy of the corresponding German Application, upon which this application claims priority, is herein specifically incorporated by reference.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. In a metallurgical mill having a furnace hall, a casting hall adjacent to said furnace hall, a continuous overhead crane track extending between said furnace hall and said casting hall and a crane riding on said track, the improvement comprising:

(a) a sound and dust insulating wall separating said furnace hall from said casting hall;

(b) said wall having a lower stationary wall element and an upper wall element closing a crane passageway between said furnace hall and said casting hall said upper wall element capable of assuming an opened and a closed position;

(c) said upper wall element comprising (i) at least three strut members which extend vertically when said upper wall element is in its closed position and extend at an angle to the vertical when said upper wall element is in its open position; and (ii) at least two adjacent, horizontally extending slats, said slats being pivotally secured, about individual horizontal axis, to said strut members;

(d) said strut members being pivotal about a single horizontal axis;

(e) said upper wall element, when in its closed position, forms a continuous sound and dust insulating surface; and (f) said upper wall element, when in its open position, has said slats extending vertically downward and blocking said passageway by an amount not to exceed the width of said slats, and allows said crane riding on said track to pass from said casting hall to said furnace hall.

2. A metallurgical mill, as claimed in claim 1, wherein:

(a) said slats have edges which are provided with flanges and recesses which cooperate with the flanges and recesses of adjacent slats when said wall element is in its closed position to thereby provide a continuous sound and dust insulating upper wall element.

3. A metallurgical mill, as claimed in claim 1, wherein:

(a) said slats are provided, on at least one of their edges, with rubber material plates;

(b) said plates project beyond the edges of said slats; and (c) said plates provide a dust and sound insulating seal for adjacent slats when said upper wall element is in its closed position.

4. A metallurgical mill, as claimed in claim 3, wherein:

(a) said plates are provided on the lower edges of said slats; and (b) said plates are located on the sides of said slats which trail said slats as said upper wall element moves from said closed position to said open position.

5. A metallurgical mill, as claimed in claim 1, wherein:

(a) a cable and winch hoisting mechanism are provided to facilitate the pivotal movement of said strut members.

6. A metallurgical mill, as claimed in claim 5, wherein:

(a) a counterweight is provided to relieve said winch when said upper wall element is in its open position.

* * * * *